United States Patent [19]

Würmli

[11] Patent Number: 4,649,699

[45] Date of Patent: Mar. 17, 1987

[54] FIBER FEED PASSAGE ARRANGEMENT FOR FRICTION SPINNING DEVICES

[75] Inventor: Arthur Würmli, Winterthur, Switzerland

[73] Assignee: Rieter Machine Works, Ltd., Winterthur, Switzerland

[21] Appl. No.: 795,504

[22] Filed: Nov. 6, 1985

[30] Foreign Application Priority Data

Nov. 13, 1984 [CH] Switzerland ..... 05418/84

[51] Int. Cl.[4] ..... D01H 7/892; D01H 7/882

[52] U.S. Cl. ..... 57/401; 57/408; 57/413

[58] Field of Search ..... 57/401, 400, 408, 411, 57/412, 413

[56] References Cited

U.S. PATENT DOCUMENTS

| | | | |
|---|---|---|---|
| 3,839,855 | 10/1974 | Stalder | 57/408 |
| 4,130,983 | 12/1978 | Dammann et al. | 57/401 X |
| 4,321,789 | 3/1982 | Dammann et al. | 57/401 X |
| 4,441,310 | 4/1984 | Parker et al. | 57/401 |
| 4,567,722 | 2/1986 | Stahlecker | 57/413 X |
| 4,570,434 | 2/1986 | Stahlecker | 57/401 |
| 4,574,581 | 3/1986 | Stahlecker | 57/401 |
| 4,584,832 | 4/1986 | Stahlecker | 57/401 |

FOREIGN PATENT DOCUMENTS

| | | |
|---|---|---|
| 1925999 | 12/1969 | Fed. Rep. of Germany . |
| 2345541 | 3/1977 | France . |
| 1574534 | 9/1980 | United Kingdom . |

*Primary Examiner*—John Petrakes

*Attorney, Agent, or Firm*—Werner W. Kleeman

[57] ABSTRACT

In a friction spinning device comprising a fiber opening assembly, a fiber feed passage arrangement, and friction spinning drums cooperating with the fiber feed passage arrangement, the fiber feed passage arrangement is divided in its longitudal direction into two passage or channel halves. At the separation or parting joints or gaps formed by connection flanges associated with the passage halves, there can be provided recesses so that a respective connecting slot is formed between the cross-section of the fiber feed passage arrangement and the separation or parting joints. In this way, there can be substantially avoided contact of fibers with the separation or parting joints.

14 Claims, 23 Drawing Figures

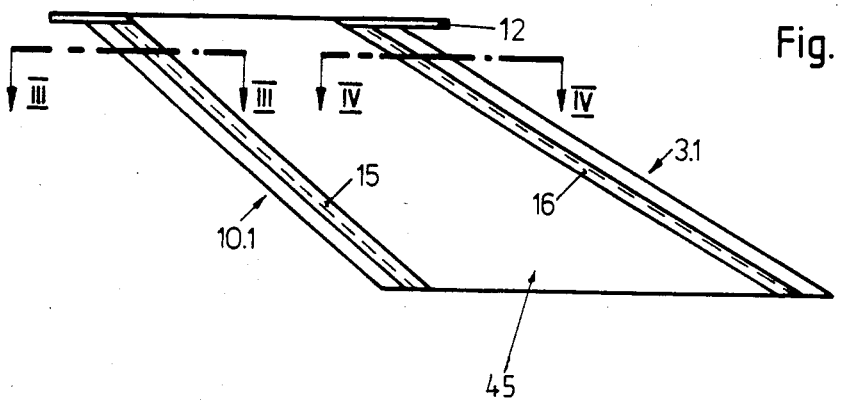
Fig. 3
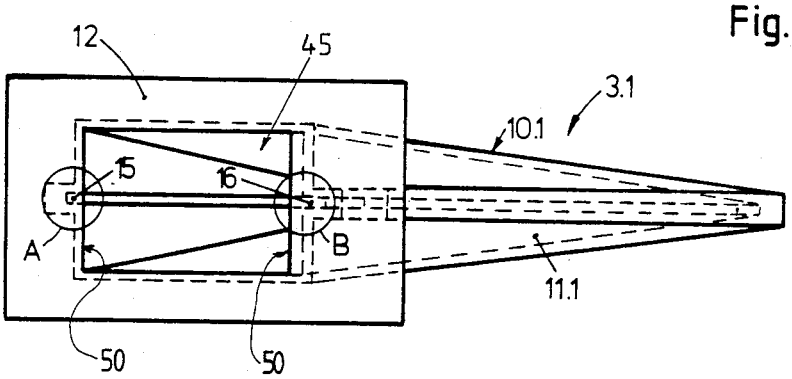
Fig. 4
Fig. 5
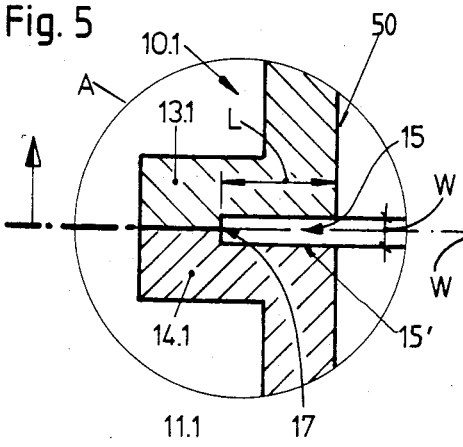
Fig. 6
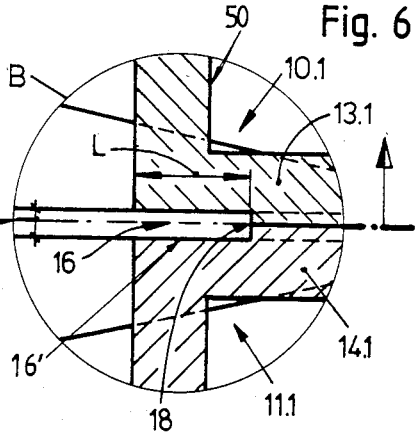

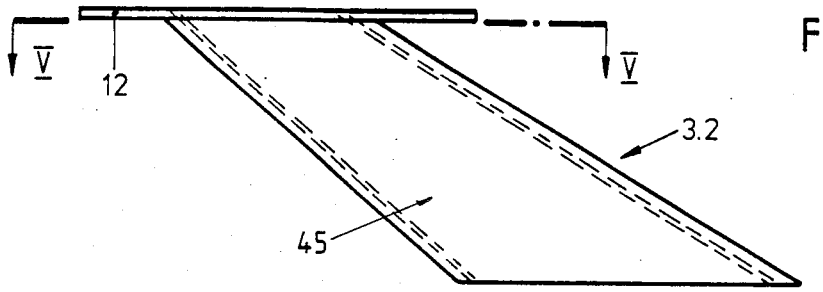
Fig. 13
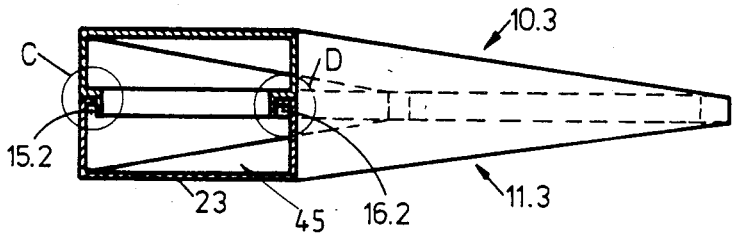
Fig. 14
Fig. 15
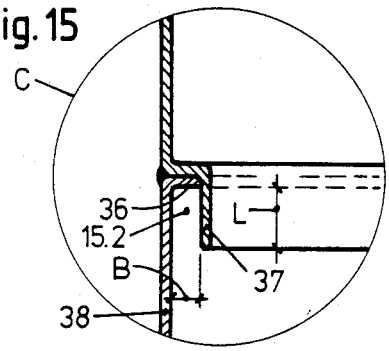
Fig. 16
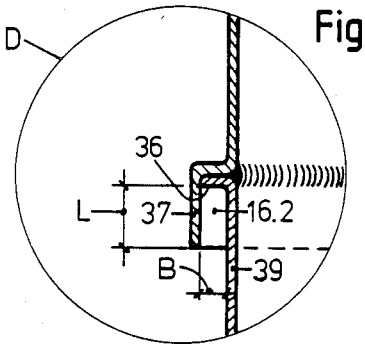
Fig. 17
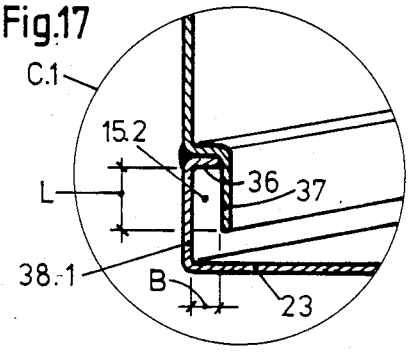
Fig. 18
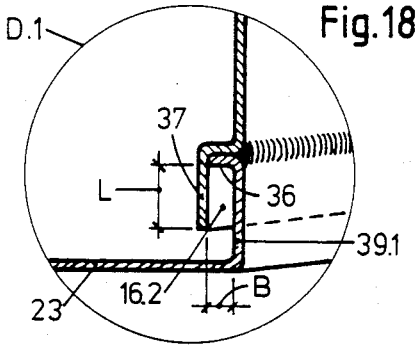

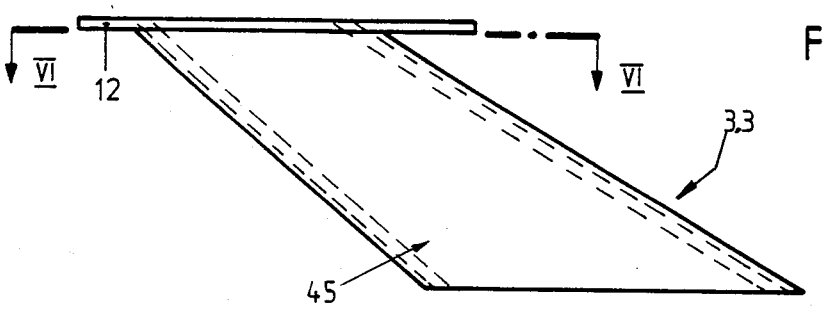
Fig. 19
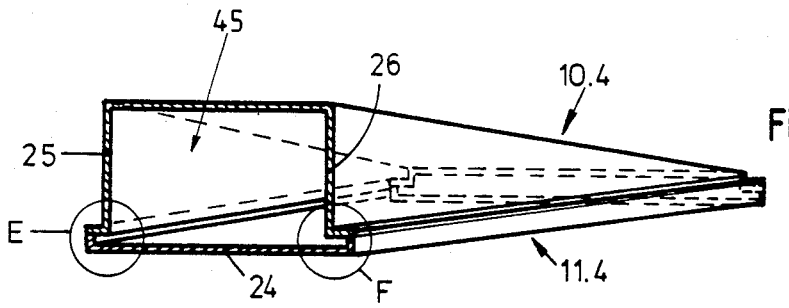
Fig. 20
Fig. 21
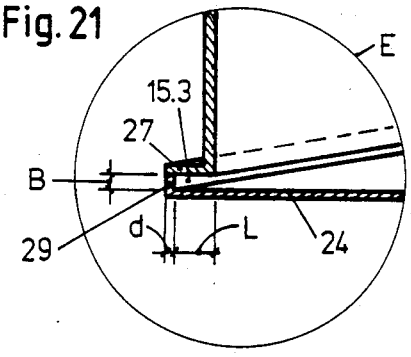
Fig. 22
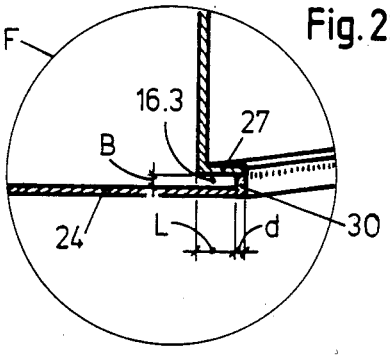
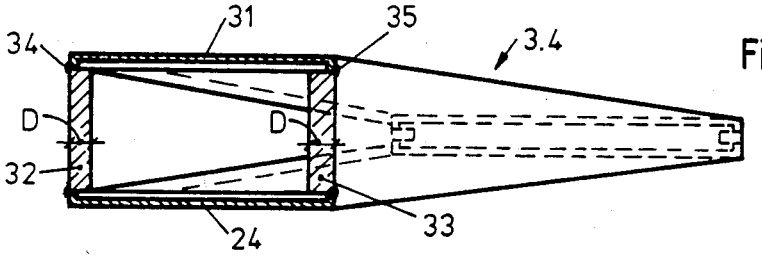
Fig. 23

FIBER FEED PASSAGE ARRANGEMENT FOR FRICTION SPINNING DEVICES

BACKGROUND OF THE INVENTION

The present invention relates to a new and improved fiber feed passage or channel arrangement for friction spinning devices for pneumatic feed of textile fibers between a fiber opening assembly and a spinning unit, the fiber feed passage arrangement being formed by an assembly of at least two adjoining or neighboring interconnected parts or components.

From European Patent Application No. 98,380 (corresponding to U.S. Pat. No. 4,441,310, granted Apr. 10, 1984), a fiber feed passage arrangement of the aforementioned general type is already known to the art. This fiber feed passage arrangement comprises a straight sidewall and an adjoining L-shaped sidewall. The straight sidewall has a flat surface against which bears the foot portion of the cooperating L-shaped counterwall so that a separating joint or gap, even if a fine one, is formed.

Such separating joints or gaps have the disadvantage that, even when they are very fine, they still tend to form proturberances or shoulders which retain the very fine fibers transported through the fiber feed passage arrangement.

SUMMARY OF THE INVENTION

Therefore, with the foregoing in mind, it is a primary object of the present invention to provide a new and improved construction of a fiber feed passage arrangement for friction spinning devices which does not exhibit the aforementioned drawbacks and limitations of the prior art constructions.

Another important object of the present invention aims at providing a new and improved construction of a fiber feed passage arrangement for friction spinning devices in which there is effectively precluded or extensively reduced, the possibility of undesirably entrapping or retaining fibers in the internal fiber feed passage or channel of the fiber feed passage arrangement.

Yet a further important object of the present invention is directed to the provision of a new and improved construction of a fiber feed passage or channel arrangement for friction spinning devices, wherein the fiber feed passage or channel arrangement is structured such that there is effectively precluded or largely minimized the danger of undesirably entrapping fibers within the fiber feed passage or channel arrangement while the latter is nonetheless relatively simple and economical in its design.

Now in order to implement these and still further objects of the invention, which will become more readily apparent as the description proceeds, the present invention is manifested by the features that the fine separation or parting joints, also referred to as joint crevices, which are formed during assembly of the longitudinal parts or components, are shifted out of the region of the actual cross-section of the fiber feed passage or channel arrangement such that between each separation or parting joint and the passage or channel cross-section of the fiber feed passage arrangement there is provided a slot or gap connecting each associated separation or parting joint with the cross-section of the fiber feed passage arrangement.

Some of the more notable advantages realized by the present invention reside in the fact that, on the one hand, there are practically no manufacturing or production limitations for the type of fiber feed passage or channel arrangement and, on the other hand, in spite of the multi-part or divided fiber feed passage arrangement there is essentially no danger that fibers will be caught or entrapped at the separation or parting joints.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 shows a detail of the friction spinning device of FIG. 1 in the same view as FIG. 1;

FIG. 4 is a top plan view of the detail shown in FIG. 3;

FIGS. 5 and 6 are respective sectional views on an enlarged scale of details of the structure shown in FIG. 4, particularly in the regions encircled and labelled by reference characters A and B, and taken along the respective section lines III—III and IV—IV of FIG. 3;

FIG. 13 shows a variant embodiment of the detail of FIG. 3 and depicted in the same view as FIG. 3;

FIG. 14 is a sectional view taken along the section line V—V of FIG. 13;

FIGS. 15 and 16 show in detail respective parts of the arrangement of FIG. 14 on an enlarged scale and depict the regions encircled and labelled in FIG. 14 by reference characters C and D respectively;

FIGS. 17 and 18 show a variant of the detail of FIGS. 15 and 16 respectively;

FIG. 19 shows a further variant embodiment of the detail of FIG. 3 and depicted in the same view as FIG. 3;

FIG. 20 shows a sectional view taken along the section line VI—VI in FIG. 19;

FIGS. 21 and 22 show respective details of the arrangement of FIG. 20 illustrated to a larger scale and depicting the regions encircled and labelled by reference characters E and F in FIG. 20; and FIG. 23 shows a variant of the detail of FIG. 19 and illustrated in sectional view corresponding to the showing of FIG. 20.

DETAILED DESCRIPTION OF THE PREFERRED EMBODIMENTS

Figure 2:
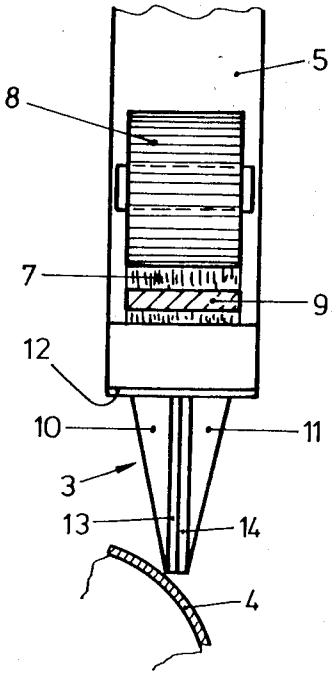
FIG. 2 shows a front view of the friction spinning device of FIG. 1 looking in the direction of the arrow I of FIG. 1.

Describing now the drawings, it is to be understood that only enough of the exemplary embodiments of friction spinning devices and their related structure have been shown to enable those skilled in the art to readily understand the underlying principles and concepts of the present invention while simplifying the illustration of the drawings. Turning attention now specifically to FIGS. 1 and 2, there is shown therein a friction spinning device 1 comprising a fiber opening assembly 2 known from open-end rotor spinning techniques, a fiber feed passage or channel arrangement 3 adjoining the fiber opening assembly 2, and a first friction spinning drum 4, only partly illustrated. The second friction spinning drum, which cooperates with the first friction spinning drum 4, has not been shown for simplicity of illustration.

By means of these two coacting friction spinning drums, the fibers delivered by the fiber feed passage or channel arrangement 3 are twisted together to form a yarn which is then withdrawn by any suitable withdrawal means not here specifically illustrated and such yarn is then wound-up. In accordance with the previously mentioned definition, the two friction spinning drums form, for example, a spinning unit.

Such friction spinning devices are well known in this art and are illustrated and described, for example, in U.S. Pat. No. 4,130,983, granted Dec. 26, 1978 to which reference may be readily had.

The fiber opening assembly 2 comprises a housing 5, a rotatably and drivably supported opening roller 6, a feed roller 8 feeding a fiber sliver 7, and a so-called troughplate 9 receiving the fiber sliver 7.

The bearings and the drive of the friction spinning drums, the opening roller 6 and the feed roller 8 are known and are also not subject matter of the present invention, and therefore are not here further described in any detail.

The fiber feed passage or channel arrangement 3 comprises a first passage or channel half 10, a second passage or channel half 11 and a connecting or connector flange 12. The two passage or channel passage halves 10 and 11 define or delimit an internal fiber feed channel or passage 45 and constitute longitudinal or longitudinally extending passage or channel halves. In other words, the fiber feed passage arrangement 3 is divided into these two passage or channel passage halves 10 and 11 in its longitudinal direction and is held together by connecting flanges 13 and 14, for example with the aid of screws or bolts or by means of soldered joints. The connecting or connector flange 12 serves to secure the fiber feed passage or channel arrangement 3 to the housing 5 of the fiber opening assembly 2.

If the two passage halves 10 and 11 of the fiber feed passage arrangement 3 are held together by means of screws or bolts or other releasable connections, then it is advantageous to divide the connecting or connector flange 12 also into two halves which are each then associated with respective related ones of the passage or channel halves 10 and 11.

The mutually contacting separating or joint surfaces of the connecting or connector flanges 13 and 14 must be constructed such that the separation or parting joints 17 and 18, respectively, (indicated in FIG. 1), formed due to the mutual contact of the connecting or connector flanges 13 and 14, have practically no locations at which fibers could be entrapped or caught.

Figure 1:
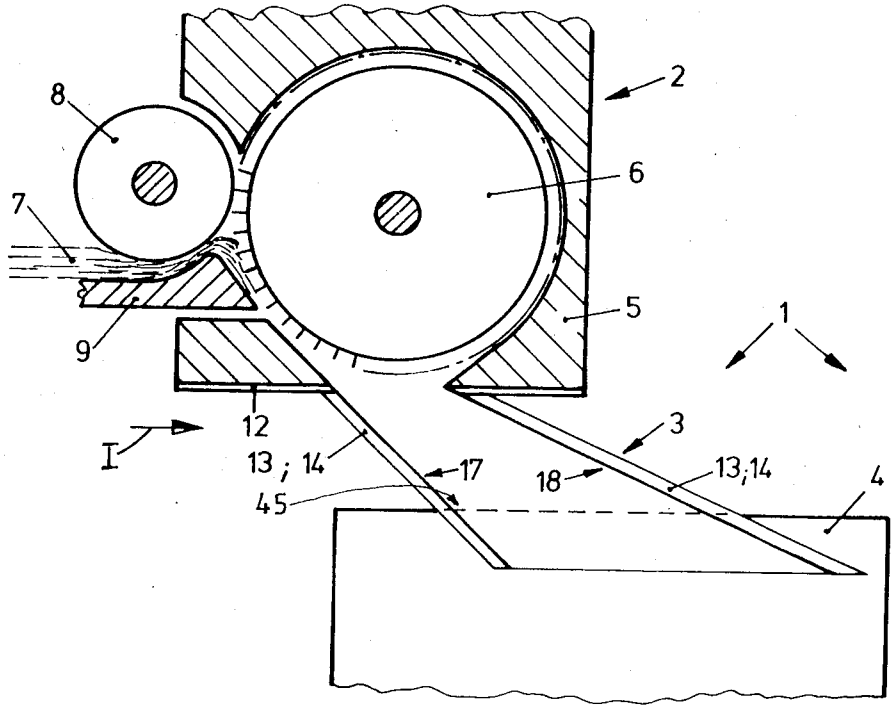
FIG. 1 shows in a partial schematic illustration a longitudinal section through a friction spinning device including a fiber feed passage or channel arrangement.

FIGS. 3 and 4 show, as a variant to the fiber feed passage or channel arrangement 3 of FIG. 1, a further construction of a fiber feed passage or channel arrangement 3.1. FIGS. 5 and 6 show, on an enlarged scale, details of the arrangement of FIG. 4 and indicated in such FIG. 4 by the encircled regions designated with reference characters A and B, respectively.

The difference between the fiber feed passage or channel arrangement 3.1 of the embodiment of FIGS. 3 and 4 and the fiber feed passage or channel arrangement 3 of the embodiment of FIG. 1 is that, in each of the connecting or joining flanges 13.1 and 14.1 (FIGS. 5 and 6, respectively) there is provided a respective recess 15' and 16' which forms a slot 15 and 16, respectively. Each such slot 15 and 16 possesses the slot depth L and slot breadth or width W.

By means of each of these slots 15 and 16, the fine separation or parting joints 17 and 18, respectively, which are formed due to the assembly of the connecting flanges 13.1 and 14.1, are shifted out of the region of the passage or channel cross-section i.e., out of the region of the internal fiber feed channel or passage 45 to the base of the associated slots 15 and 16, respectively. The separation or parting joints 17 and 18 are located in the middle of the base of each associated slot 15 and 16, respectively.

The advantage of these slots 15 and 16, respectively, is that, with an advantageous relationship between the slot depth L and the slot width W, with a minimum slot width of 0.1 mm and a maximum slot width of 0.5 mm, the fibers conveyed or fed in the passage or channel cross-section or internal passage 45 of the fiber feed passage or channel arrangement 3.1 are subjected to less risk of coming into contact with the separation or parting joints 17 and 18, respectively, so that there is a smaller danger that these fibers will be entrapped or caught in such separation or parting joints 17 and 18.

The minimum relationship of slot depth L to slot width W is 5:1 and for practical reasons the maximum relationship L:W is 10:1.

Each slot or gap 15 and 16 is formed or extends throughout the complete length of the fiber feed passage or channel arrangement 3.1, with the exception of the connecting flange 12, and can have a widened or enlarged portion at the region of the outlet end or discharge region of the feed passage or channel arrangement 3.1.

Figure 7:
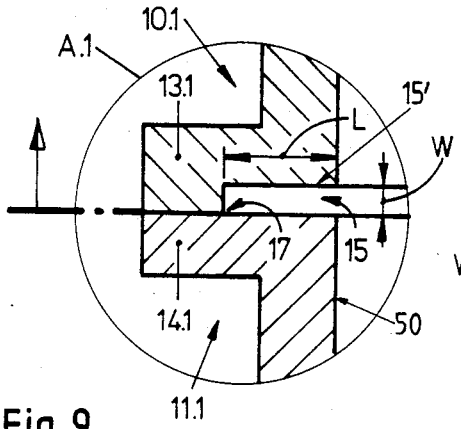
FIGS. 7 and 8 show a variant of the details of FIGS. 5 and 6 respectively.
Figure 8:
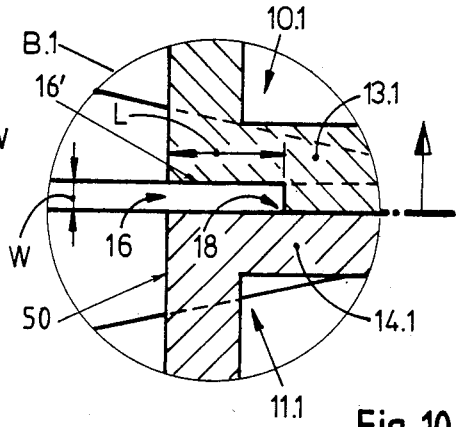

FIGS. 7 and 8 show a variant embodiment as compared with the embodiment illustrated in FIGS. 4, 5 and 6. Here, the separation or parting joints 17 and 18 are not located in the middle of the base of the associated slot 15 and 16, respectively, but are located completely in one corner of the base of each such associated slot 15 and 16. This variant is produced in that each recess 15' and 16' forming the associated slot 15 and 16, respectively, is provided in only one of the two connecting flanges 13.1 or 14.1, for example, in the embodiment under discussion, in the connecting flange 13.1 as clearly shown in FIGS. 7 and 8. Since in all other respects the same elements or parts are present in this embodiment as in the embodiment of FIGS. 5 and 6, these elements or parts of the embodiment of FIGS. 7 and 8 are conveniently generally indicated with the same reference numerals.

The advantages of this variant embodiment resides in the simpler manufacture of a precise separating or parting joint or gap in which there is no possibility of shifting the joint surfaces relative to each other in such a manner that the base of the slot, stated in an exaggerated fashion, takes on a step-shaped configuration.

Figure 9:
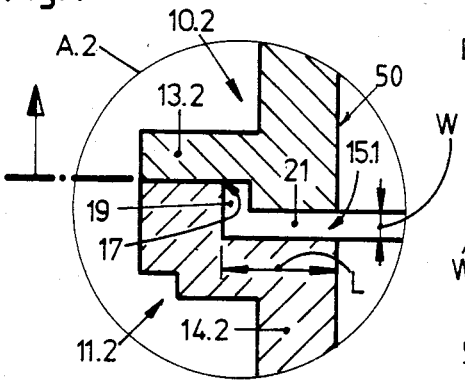
FIGS. 9 and 10 show a still further variant of the details of FIGS. 5 and 6 respectively.
Figure 10:
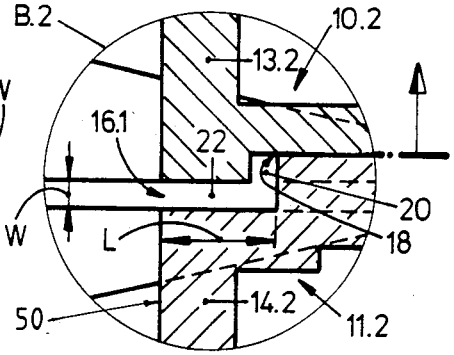

FIGS. 9 and 10 show a respective substantially boot-shaped slot or gap 15.1 and 16.1. Each foot portion 19 and 20 of the slots or gaps 15.1 and 16.1, respectively, is directed upwardly in the showing of FIGS. 9 and 10. It is not, however, essential to the invention whether each such foot portion 19 and 20 is directed upwardly, downwardly or at an angle which differs from a right angle, as such right angle has been shown in FIGS. 9 and 10.

An essential point is simply that the separation or parting joints 17 and 18 are not located in the region of the leg portions 21 and 22, respectively, but are laterally shifted and to a certain degree are hidden at the end of the foot portions 19 and 20, respectively.

With the exception of the adaptations caused by the substantially boot-shaped slots or gaps 15.1 and 16.1, the elements or parts or components of FIGS. 9 and 10 are essentially the same as those of FIGS. 7 and 8, and therefore the basic reference symbols for the elements have been generally retained and only the indexes of the reference symbols have been sometimes changed.

A major advantage of the variant embodiment illustrated in these two FIGS. 9 and 10 is that the fibers have still less possibility of undesirably passing into the separation or parting joints 17 and 18, respectively.

Figure 11:
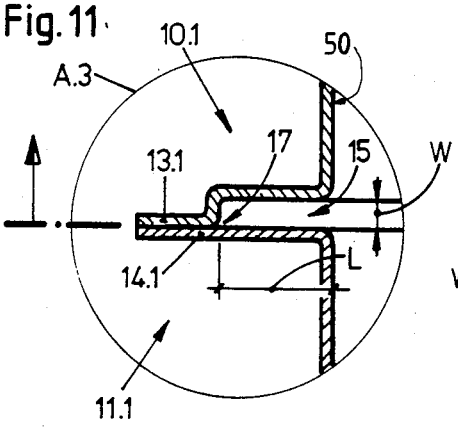
FIGS. 11 and 12 show yet a further variant of the details of FIGS. 5 and 6 respectively.
Figure 12:
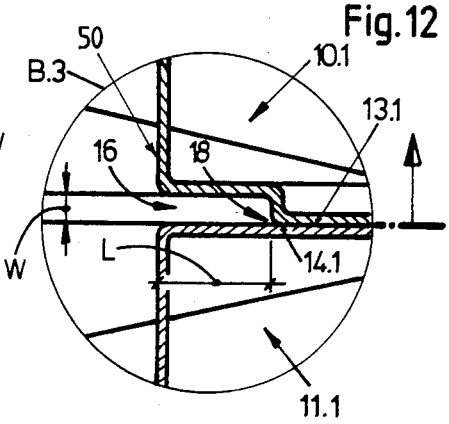

The variant embodiment illustrated in FIGS. 11 and 12 corresponds, in accordance with the invention, to the variant embodiment illustrated in FIGS. 7 and 8 with the sole difference that here the fiber feed passage or channel halves are not parts or components produced by injection molding but parts or components manufactured from sheet metal or metal plating. Accordingly, the elements or components are therefore generally conveniently indicated with the same reference characters in FIGS. 11 and 12 as were used for the corresponding elements or components of the embodiment of FIGS. 7 and 8.

The circular portions or regions indicated by reference characters A and B in FIGS. 4, 5 and 6 are indicated in FIGS. 7 to 12 by reference characters A.1 to A.3 and B.1 to B.3, respectively.

FIGS. 13 to 16 also show a fiber feed passage or channel arrangement 3.2 which can be manufactured from sheet metal or metal plating. This fiber feed passage or channel arrangement 3.2 comprises a first feed passage or channel half 10.3 and a second feed passage or channel half 11.3 together with the connecting or connector flange 12. The difference between the previous embodiments and the embodiment of these FIGS. 13 to 16 is such that each slot 15.2 and 16.2, respectively, is not disposed at right angles to the sidewalls 50 defining or bounding the feed passage or channel cross-section or internal fiber feed passage or channel 45 as was the case for the embodiments illustrated in FIGS. 4 to 12, but in this case is directed essentially parallel to these bounding sidewalls which in FIGS. 15 and 16 have however been conveniently designated by reference characters 38 and 39 (in such FIGS. 15 and 16 there are shown on an enlarged scale the details or regions indicated in FIG. 14 at the encircled portions labelled C and D).

Such a slot or gap 15.2 and 16.2 is produced in that the connecting or connector flanges 36 and 37, respectively, are provided such that they are directed into the feed passage or channel cross-section i.e. into the internal fiber feed passage or channel 45. The connecting or connector flange 37 of the first half of the feed passage or channel 10.3 is bent or flexed in a direction essentially parallel to the neighboring or bounding sidewall 50 such that the other connecting or connector flange 36 of the second half of the feed passage or channel 11.3 is overlapped by the slot depth L. Through this overlapping of the connecting or connector flange 36 by the connecting or connector flange 37, there are formed the slots or gaps 15.2 and 16.2, respectively. Each such slot 15.2 and 16.2 possesses the slot width W. This slot width W is formed, on the one hand, as already mentioned, by the connecting or connector flange 37 and, on the other hand, by the bounding sidewall portions 38 and 39, respectively, of the second half 11.3 of the fiber feed passage or channel 3.2.

The advantage of this variant embodiment of FIGS. 14 to 16 is that the separation or parting joints 17 and 18 can hardly be reached by the fibers.

FIGS. 17 and 18 show a further variant of the fiber feed passage or channel arrangement 3.2 illustrated in FIG. 14 in so far as here the connecting or connector flanges 36 and 37 are not arranged in the region of the middle of the fiber feed passage or channel arrangement 3.2 but are shifted towards a longitudinal wall 23 of such fiber feed passage or channel arrangement 3.2. Due to this arrangement, there is formed a respective slot or gap 15.2 and 16.2 in a location of the embodiment shown in FIGS. 17 and 18 which has the advantage of being still further spaced from the flow of fibers than the slots 15.2 and 16.2 illustrated for the embodiment of FIGS. 15 and 16. These bounding sidewalls 38 and 39 of FIGS. 15 and 16 correspond functionally to the bounding sidewalls 38.1 and 39.1 of FIGS. 17 and 18, respectively.

Since the arrangement of FIGS. 17 and 18 is a variant of the embodiment of FIGS. 14 to 16, the details enclosed in the encircled regions C and D of FIG. 14 have been shown in FIGS. 17 and 18 in the encircled regions there designated by reference characters C.1 and C.2.

FIGS. 19 and 20 show a further variant embodiment in which the fiber feed passage or channel arrangement 3.3 comprises two fiber feed passage or channel halves 10.4 and 11.4.

The difference here resides in that each slot, (see for instance, the slots 15.3 and 16.3 of FIGS. 21 and 22), is arranged completely at the edge of the air flow or current transporting the fibers, in that each such slot or gap is defined or bounded in its width B, on the one hand, by the longitudinal wall 24 forming the feed passage or channel half 11.4, and, on the other hand, by feet 27 and 28, respectively, (FIGS. 21 and 22) provided at the sidewalls 25 and 26 of the first half 10.4 of the feed passage or channel 3.3. The longitudinal wall 24 is provided at its longitudinal sides or edges with bends or flexed portions 29 and 30 upon which the feet 27 and 28 of the sidewalls 25 and 26 are supported. The connection of the feet 27 and 28 with the bends or flexed portions 29 and 30 of the longitudinal wall 24 can be accomplished by any suitable connecting or attachment technique, for example by soldering.

FIG. 23 shows a variant embodiment of FIG. 20 in that here the fiber feed passage or channel arrangement 3.4 is formed by the longitudinal wall 24 and a mirror-image arranged second longitudinal wall 31 together with two sidewalls 32 and 33. The second longitudinal wall 31 has feet 34 and 35 of the same dimensions arranged mirror-image to the feet 29 and 30 of the longitudinal wall 24.

The sidewalls 32 and 33 have a thickness D which corresponds to the depth L of the slots or gaps 15.3 and 16.3, respectively, plus the width d of the bends or flexed portions or feet 29 and 30, respectively. These slots 15.3 and 16.3 are arranged substantially at right angles to the corresponding sidewalls 25 and 26 or 32 and 33, respectively.

If, now, during assembly of the fiber feed passage or channel 3.4, the longitudinal walls 24 and 31 are so joined to the sidewalls 32 and 33 that the feet 29 and 30 or 34 and 35 abut the end faces of the sidewalls 32 and 33, and also the sidewalls 32 and 33 project inwardly of the feed passage or channel 3.4, then the slot 15.3 and 16.3, respectively is formed at the two end faces of the sidewalls 32 and 33. The longitudinal walls 24 and 31 can be joined or connected by any kind of appropriate connector means, for example by soldering to the sidewalls 32 and 33.

The advantage of this variant embodiment lies in the simple form or nature of the individual elements or components, and in that each slot or gap 15.3 and 16.3, respectively, is located at the edge of the fiber feed flow or stream.

Finally, it is mentioned that the respective slot or gap in FIGS. 4 to 8, 11 and 12, and 20 to 23, seen in the direction of the associated slot or gap, is substantially straight, while the slots or gaps of FIGS. 9 and 10, seen in the same direction of viewing, are bent in a substantially boot-shape. The slots or gaps of FIGS. 14 to 18 are straight in the previously-mentioned sense, but due to the disposition of a portion thereof which extends essentially parallel to the associated sidewalls, seen in the direction of viewing towards the aforesaid sidewalls, such slots are also bent or flexed in a substantially boot-shaped fashion.

Finally, the term "feed cross-section" or "passage or channel cross-section" or "cross-section of the fiber feed passage" as used herein refers to the interior of the fiber feed passage or channel arrangement but without the respective associated slots or gaps.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A fiber feed passage arrangement for friction spinning devices for pneumatic feed of textile fibers between a fiber opening assembly and a spinning unit, said fiber feed passage arrangement comprising:

an assembly of at least two adjoining longitudinal parts;

said assembly of at least two adjoining longitudinal parts including therebetween fine separation joints;

said two adjoining longitudinal parts forming therein a fiber feed passage through which there are conveyed the textile fibers from the fiber opening assembly to the spinning unit; and said fine separation joints being shifted out of the region of the cross-section of the fiber feed passage such that between each said fine separation joint and the cross-section of the fiber feed passage there is present a respective slot connecting the associated separation joint with the cross-section of the fiber feed passage.

2. The fiber feed passage arrangement as defined in claim 1, wherein:

each said slot has a length and a width; and the length of each said slot has a minimum ratio of approximately 5:1 to its width.

3. The fiber feed passage arrangement as defined in claim 2, wherein:

said slot width is at least 0.1 mm.

4. The fiber feed passage arrangement as defined in claim 1, wherein:

each said slot has a base; and each said fine separation joint being located approximately in the middle of the base of its associated slot.

5. The fiber feed passage arrangement as defined in claim 1, wherein:

each said slot has a base; and each said fine separation joint being located completely in a corner of the base of the associated slot.

6. The fiber feed passage arrangement as defined in claim 1, wherein:

each said slot, viewed substantially in the lengthwise direction of extent of said slot, is substantially straight.

7. The fiber feed passage arrangement as defined in claim 6, wherein:

said fiber feed passage possesses a respective sidewall adjacent each associated slot; and each said slot is disposed substantially parallel to its associated sidewall.

8. The fiber feed passage arrangement as defined in claim 7, wherein:

said fiber feed passage is symmetrically divided such that the separation joints are located substantially in a central region of the fiber feed passage.

9. The fiber feed passage arrangement as defined in claim 7, wherein:

said fiber feed passage is bounded by longitudinal walls; and said fiber feed passage being symmetrically divided substantially such that said fine separation joints are located close to an inner side of an associated longitudinal wall of the fiber feed passage.

10. The fiber feed passage arrangement as defined in claim 6, wherein:

said fiber feed passage possesses a respective sidewall adjacent each associated slot; and each said associated slot being disposed substantially at right angles to its associated sidewall.

11. The fiber feed passage arrangement as defined in claim 10, wherein:

said fiber feed passage is symmetrically divided such that said fine separation joints are located substantially in a central region of the fiber feed passage.

12. The fiber feed passage arrangement as defined in claim 10, wherein:

said fiber feed passage is bounded by longitudinal walls; and said fiber feed passage being symmetrically divided substantially such that said fine separation joints are located close to an inner side of an associated longitudinal wall of the fiber feed passage.

13. The fiber feed passage arrangement as defined in claim 1, wherein:

each said slot, viewed substantially in the lengthwise direction of extent of said slot, possesses a substantially boot-shaped configuration.

14. A fiber feed passage arrangement for friction spinning devices for pneumatic feed of textile fibers between a fiber opening assembly and a spinning unit, said fiber feed passage arrangement comprising:

at least two neighboring interconnected longitudinal components defining at abutting surfaces thereof two parting joints;

said two neighboring interconnected longitudinal components defining sidewalls bounding an internal fiber feed channel through which there are conveyed the textile fibers from the fiber opening assembly to the spinning unit; and said parting joints being located remote from said sidewalls of said internal fiber feed channel such that between each parting joint and the internal fiber feed channel there is provided a respective slot connecting the associated parting joint with the internal fiber feed channel.

* * * * *